US009677232B2

(12) United States Patent
Zwerneman

(10) Patent No.: US 9,677,232 B2
(45) Date of Patent: Jun. 13, 2017

(54) RETRACTABLE SPEED BARRIER

(71) Applicant: Robert C. Zwerneman, The Woodlands, TX (US)

(72) Inventor: Robert C. Zwerneman, The Woodlands, TX (US)

( * ) Notice: Subject to any disclaimer, the term of this patent is extended or adjusted under 35 U.S.C. 154(b) by 0 days.

(21) Appl. No.: 14/924,529

(22) Filed: Oct. 27, 2015

(65) Prior Publication Data

US 2017/0081814 A1 Mar. 23, 2017

Related U.S. Application Data

(60) Provisional application No. 62/219,675, filed on Sep. 17, 2015.

(51) Int. Cl.
*E01F 11/00* (2006.01)
*E01F 9/529* (2016.01)

(52) U.S. Cl.
CPC ..... *E01F 9/529* (2016.02)

(58) Field of Classification Search
CPC ..... E01F 9/529; E01F 15/00
USPC ..... 404/6, 9, 11, 13, 15; 49/131
See application file for complete search history.

(56) References Cited

U.S. PATENT DOCUMENTS 1,203,006 A * 10/1916 Keenan ..... E01F 13/08 404/6
1,356,922 A * 10/1920 Keenan ..... E01F 13/08 49/131
1,365,165 A * 1/1921 Garcia ..... A01K 3/002 49/131
1,497,073 A * 6/1924 Doyle ..... E01F 13/046 246/293
1,616,809 A * 2/1927 Kuhn ..... B61L 29/24 246/473.1
1,649,877 A * 11/1927 Walston ..... E01F 9/529 116/DIG. 16
3,724,333 A * 4/1973 Fonden ..... B64F 1/02 244/110 F
4,012,156 A 3/1977 Turner et al.
4,342,525 A 8/1982 Mastronuzzi
(Continued)

FOREIGN PATENT DOCUMENTS

CA 2222088 A1 1/1997
EP 1995381 B1 7/2015
WO 2014102411 A1 7/2014

OTHER PUBLICATIONS

"Sensor Technologies for Doors, Gates and Elevators", Pepperl+Fuchs http://www.prosoft.ru/cms/f/446316.pdf.*
(Continued)

*Primary Examiner* — Thomas B Will
*Assistant Examiner* — Katherine Chu
(74) *Attorney, Agent, or Firm* — Basil M. Angelo; Angelo Mikeska PLLC

(57) ABSTRACT

A retractable speed barrier system includes a winged speed barrier assembly, a lateral pivoting assembly that includes a plurality of trapezoidal hinges, a hollow frame assembly, and an electrically activated linear actuator. The winged speed barrier assembly is attached to the hollow frame assembly by the lateral pivoting assembly. The linear actuator causes the winged speed barrier assembly to laterally pivot on the trapezoidal hinges in a direction perpendicular to the flow of traffic between a retracted position and a deployed position.

19 Claims, 8 Drawing Sheets

(56) References Cited

U.S. PATENT DOCUMENTS 4,490,068 A * 12/1984 Dickinson ..... E01F 13/08 404/11
4,711,608 A * 12/1987 Ghusn ..... E01F 13/08 404/6
4,775,261 A * 10/1988 Fladung ..... E01F 13/08 404/6
RE33,201 E * 4/1990 Dickinson ..... E01F 13/08 404/6
4,974,991 A 12/1990 Mandavi
5,009,542 A * 4/1991 Hardin, Jr. ..... E01F 15/12 404/6
5,136,810 A * 8/1992 DeWitt, III ..... E01F 13/06 49/141
5,267,808 A * 12/1993 Welford ..... E01F 9/529 404/11
5,509,753 A 4/1996 Thompson
6,010,277 A 1/2000 Follman
6,409,418 B1 * 6/2002 Blair ..... E01F 13/123 404/6
6,457,900 B2 10/2002 Bond
7,011,470 B1 3/2006 Breazeale et al.
7,114,873 B2 * 10/2006 Rastegar ..... E01F 9/529 404/6
7,507,052 B2 3/2009 Griffiths
7,744,064 B2 * 6/2010 Orriere ..... E04H 4/06 256/1
8,439,594 B1 * 5/2013 Clark ..... E01F 13/12 256/13.1
2003/0053860 A1 3/2003 Hall
2005/0265781 A1 * 12/2005 Blair ..... E01F 13/123 404/6
2007/0160420 A1 * 7/2007 Aoki ..... E01F 15/006 404/6
2007/0264080 A1 * 11/2007 Miracle ..... E01F 13/044 404/6
2008/0075529 A1 * 3/2008 Gelfand ..... E01F 13/12 404/6
2012/0282024 A1 11/2012 Hua
2013/0209169 A1 8/2013 Chew et al.
2014/0227031 A1 * 8/2014 Fifi ..... E01F 9/529 404/15

OTHER PUBLICATIONS

"Pepperl+Fuchs Releases Guide to Sensor Technology for Doors, Gates and Elevators", Automation.com, Sep. 12, 2006 http://www.automation.com/product-showcase/pepperlfuchs-releases-guide-to-sensor-technology-for-doors-gates-and-elevators.*

TraffiCalm Systems, TraffiCalm Driver Feedback Sign Display Trailer, retrieved from http://www.trafficalm.com/resources on Sep. 28, 2015.

TraffiCalm Systems, Wrong Way Alert, Scalable Wrong Way Warning System, retrieved from http://www.trafficalm.com/resources on Sep. 28, 2015.

* cited by examiner

RETRACTABLE SPEED BARRIER

CROSS-REFERENCE TO RELATED APPLICATIONS

This application claims the benefit of, or priority to, U.S. Provisional Patent Application Ser. No. 62/219,675, filed on Sep. 17, 2015, which is hereby incorporated by reference in its entirety.

BACKGROUND OF THE INVENTION

Modern automotive safety systems have dramatically increased the survivability of automotive accidents for occupants of a vehicle. However, the effectiveness of such systems decreases with increasing vehicular speed. While the annual number of fatalities on United States roadways continues to trend downward, speeding remains a contributing factor in approximately one third of all fatal accidents year-over-year. As such, vehicular speed remains the primary contributing factor to preventable fatalities. Despite the dangers presented by vehicular speed to drivers and others who share the roadway, efforts to change driver behaviors have proven ineffective. The driving public remains largely indifferent to speeding despite the risk to their safety and that of others. As such, many jurisdictions have imposed civil and/or criminal sanctions in an effort to reduce speeding. However, the police are understaffed and cannot adequately enforce speed restrictions.

While speeding presents a serious danger to drivers and others who share the roadway, speeding is substantially more dangerous to pedestrians, including children, on neighborhood streets, in school zones, and in parking lots. The National Highway Traffic Safety Administration has determined that a pedestrian hit by a vehicle going 20 MPH has a 90% chance of surviving, however, a pedestrian hit by a vehicle going 30 MPH has a 50% chance of surviving, and a pedestrian hit by a vehicle going 40 MPH has only a 10% chance of surviving. The statistics suggest that even modest speeding in these low-speed designated zones represents a substantially increased danger to the lives of pedestrians. As such, it is critically important to control vehicular speed on streets and roadways where pedestrians are present.

BRIEF SUMMARY OF THE INVENTION

According to one aspect of one or more embodiments of the present invention, a retractable speed barrier system includes a winged speed barrier assembly, a lateral pivoting assembly that includes a plurality of trapezoidal hinges, a hollow frame assembly, and an electrically activated linear actuator. The winged speed barrier assembly is attached to the hollow frame assembly by the lateral pivoting assembly. The linear actuator causes the winged speed barrier assembly to laterally pivot on the trapezoidal hinges in a direction perpendicular to the flow of traffic between a retracted position and a deployed position.

Other aspects of the present invention will be apparent from the following description and claims.

DETAILED DESCRIPTION OF THE INVENTION

Figure 1A:
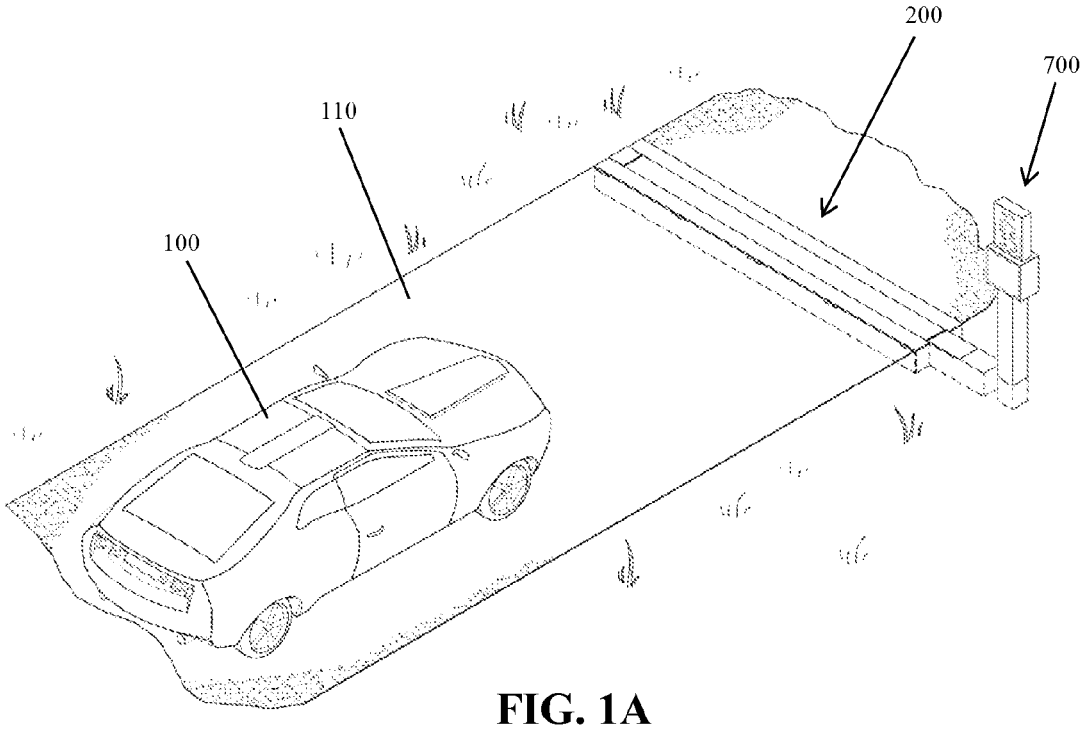
FIG. 1A shows a perspective view of an oncoming vehicle approaching a retractable speed barrier system in a retracted position in accordance with one or more embodiments of the present invention.

One or more embodiments of the present invention are described in detail with reference to the accompanying figures. For consistency, like elements in the various figures are denoted by like reference numerals. In the following detailed description of the present invention, specific details are set forth in order to provide a detailed understanding of the present invention. In other instances, well-known features to one of ordinary skill in the art are not described to avoid obscuring the description of the present invention.

As discussed above, speeding on neighborhood streets, in school zones, and in parking lots presents a dangerous situation when pedestrians are present. Speeding is particularly problematic in neighborhoods, where pedestrians, including children, are often found, because neighborhood streets are increasingly being used by drivers to cut through traffic. Because of the substantial risks associated with even modest levels of speeding and the inability to change or regulate driver behaviors, physical control of vehicular speeds is needed.

Conventional speed bumps physically control vehicular speeds by providing some manner of vertical deflection to oncoming vehicles. Conventional speed bumps typically provide less than 1', and usually less than 6", of vertical deflection from the surface of the street or roadway. If an oncoming vehicle attempts to traverse a conventional speed bump at an excessive speed, the impact with the speed bump is jarring and potentially damages the undercarriage of the vehicle, thus encouraging drivers to self-regulate their speed. Conventional speed bumps are typically composed of asphalt, concrete, metal, rubber, plastic, or combinations thereof and are typically fixed in place and cannot be easily removed once installed.

While conventional speed bumps are effective at physically controlling vehicular speeds, they also present a number of issues that contraindicate their use. Once installed, conventional speed bumps are always present and substantially reduce the speed at which a street or roadway may be traversed. This is particularly problematic when, for example, a school is located on a major thoroughfare. While it is desirable to physically control vehicular speeds during posted school zone hours, it is undesirable to impose reduced speeds at other times because doing so impedes the flow of traffic. In addition, the use of conventional speed bumps impedes emergency response vehicles such as police, fire, and emergency medical services vehicles from responding as fast as they otherwise could in an emergency situation.

Conventional retractable speed bumps seek to address some of the issues that prevent the use of conventional speed bumps by retractably deploying a speed bump only under certain conditions. However, conventional retractable speed bumps suffer from a number of issues that contraindicate their use as well, as is evidenced by their lack of adoption despite recognition of their utility. Conventional retractable speed bumps typically use a vertical lifting scheme that requires hydraulic, pneumatic, or other pressure system to vertically lift the speed bump from the retracted position to the deployed position. The vertical lifting scheme requires substantial force to deploy the speed bump, is slow to deploy, and requires a hydraulic, pneumatic, or other pressure system that has a large footprint that precludes their use in, for example, a neighborhood street that is space constrained or otherwise unavailable for aesthetic reasons. In addition, conventional retractable speed bumps typically require a large number of precision engineered components that are expensive, difficult to manufacture, and are used as part of a complex mechanical design. As such, conventional retractable speed bumps are prone to failure and are difficult to maintain.

Accordingly, in one or more embodiments of the present invention, a retractable speed barrier system is designed to be placed into the street or roadway and secured in place such that it becomes an integral structure embedded in the street or roadway substrate, thereby providing an immovable and structurally sound system that mirrors the functionality of a conventional speed bump when deployed. Unlike conventional speed bumps, the retractable speed barrier system is designed to be virtually undetectable to drivers of vehicles who obey the speed limit as the system remains in the retracted, or inactive, position. In one or more embodiments of the present invention, a retractable speed barrier system uses a lateral pivoting scheme that includes a plurality of trapezoidal hinges that pivot a winged speed barrier assembly between a retracted position and a deployed position in a lateral manner that is perpendicular to the flow of traffic. The lateral pivoting scheme allows for faster deployment and retraction of the winged speed barrier assembly over conventional lifting schemes. The lateral pivoting motion requires substantially less force than conventional lifting schemes and the winged speed barrier assembly may be deployed or retracted in less than one second. In addition, the retractable speed barrier system requires substantially fewer parts, is less complex, and is more robust that conventional solutions. As such, the retractable speed barrier system is more cost effective, easier to install, easier to maintain, and simply works better than conventional solutions.

FIG. 1A shows a perspective view of an oncoming vehicle 100 approaching a retractable speed barrier system 200 in a retracted position in accordance with one or more embodiments of the present invention. The retractable speed barrier system 200 is disposed within a street or roadway 110 and remains in a refracted, or inactive, position such that the top surface of the system 200 is substantially flush, or level, with the grade of the street or roadway 110 until activated for deployment. When in the retracted position, the retractable speed barrier system 200 bridges the street on either side of the system 200, provides substantially no vertical deflection, and has a noise signature similar to that of a rumble strip. The retractable speed barrier system 200 may be deployed when certain criterion or criteria for activation, or deployment, are met. The criterion or criteria for activation may vary based on a type, design, and/or configuration of an activation system 700 in accordance with one or more embodiments of the present invention.

Figure 1B:
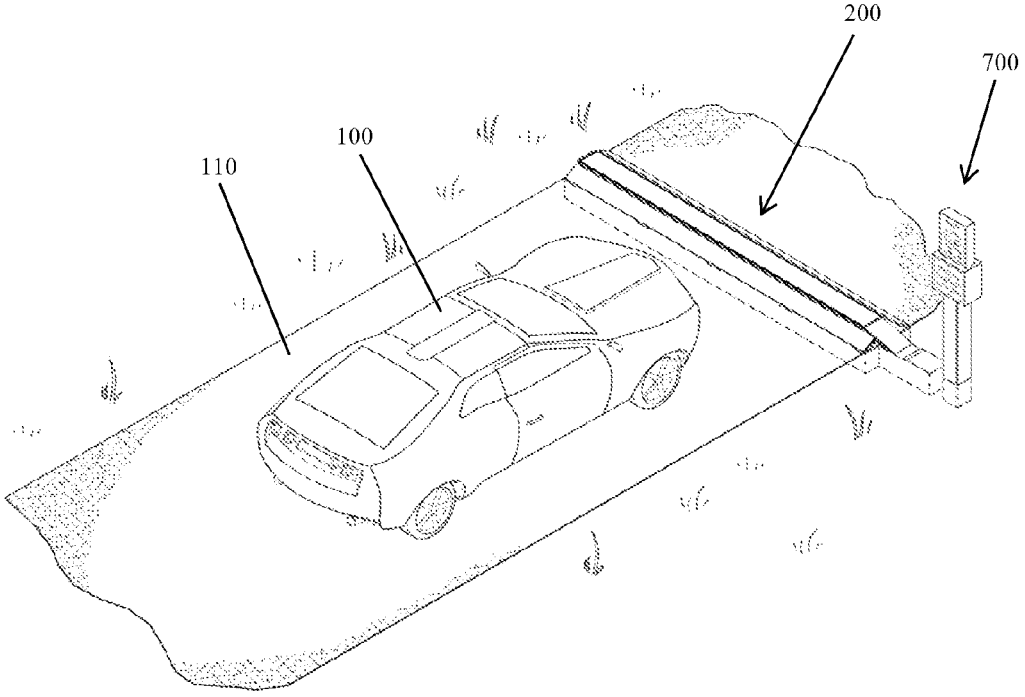
FIG. 1B shows a perspective view of the oncoming vehicle approaching the retractable speed barrier system in a deployed position in accordance with one or more embodiments of the present invention.

FIG. 1B shows a perspective view of an oncoming vehicle 100 approaching the retractable speed barrier system 200 in a deployed position in accordance with one or more embodiments of the present invention. In certain embodiments, activation system 700 may include a RAdio Detection And Ranging ("RADAR") detection system (not independently illustrated) configured to detect a speed of the oncoming vehicle 100 at a predetermined distance from the system 200. The predetermined distance may vary based on an application or design. If the oncoming vehicle 100 exceeds a predetermined speed at the predetermined distance, the retractable barrier system 200 may deploy. The predetermined speed may also vary based on an application or design. Once the vehicle 100 has passed, the retractable barrier system 200 may retract, such that the system 200 is returned to the retracted, or inactive, position. If the oncoming vehicle 100 approaches at a speed less than the predetermined speed at the predetermined distance, the retractable barrier system 200 remains in the retracted, or inactive, position and the vehicle 100 may traverse the system 200 in the retracted position. In other embodiments, the activation system 700 may include a Light Detection And Ranging ("LiDAR") detection system (not independently illustrated) that uses LiDAR to detect the speed of the oncoming vehicle 100. In still other embodiments, the activation system 700 may include a speed detection camera system (not independently illustrated) that uses one or more charge-coupled device ("CCD") cameras to detect the speed of the oncoming vehicle 100. In still other embodiments, the activation system 700 may include a switch (not independently illustrated) configured to deploy the system 200 in a first switch state and to retract in a second switch state, similar to that of an on-off switch. In still other embodiments, the activation system 700 may include a timer system (not independently illustrated) configured to deploy the system 200 at a first predetermined time and retract at a second predetermined time. One of ordinary skill in the art will recognize that any other activation and/or detection systems capable of electrically triggering the deployment and retraction of the retractable speed barrier system 200 may be used in accordance with one or more embodiments of the present invention.

Figure 2A:
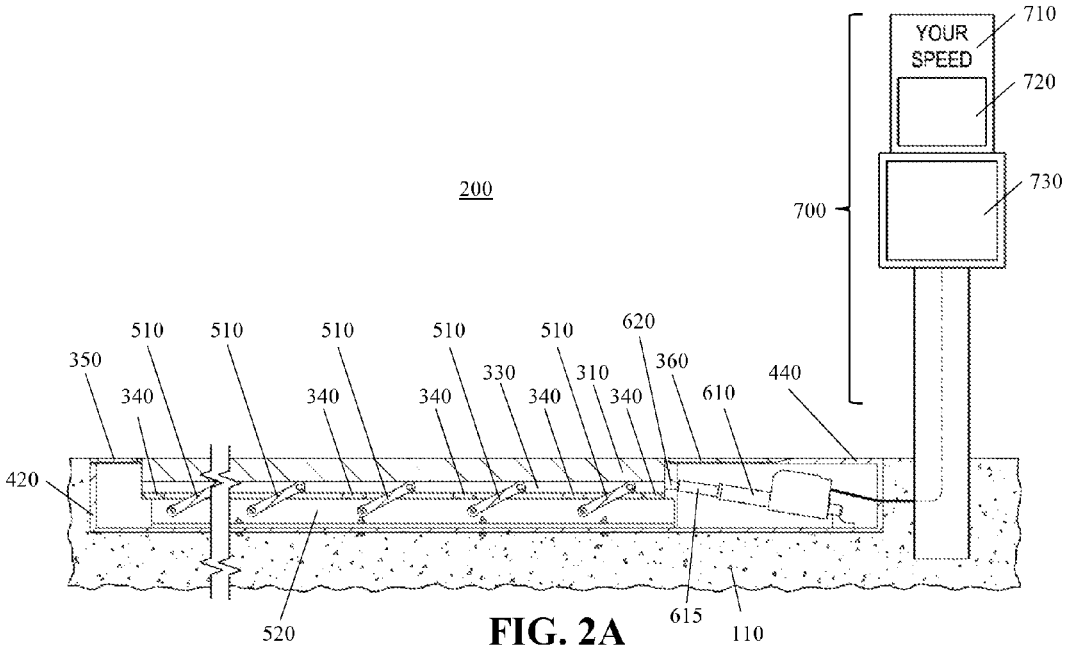
FIG. 2A shows a cross-sectional longitudinal view of a retractable speed barrier system in a retracted position in accordance with one or more embodiments of the present invention.

FIG. 2A shows a cross-sectional longitudinal view of a retractable speed barrier system 200 in a retracted position in accordance with one or more embodiments of the present invention. Retractable speed barrier system 200 includes a winged speed barrier assembly, a lateral pivoting assembly, and a hollow frame assembly discussed in more detail herein. In the retracted, or inactive, position, retractable speed barrier system 200 includes a bump board 310, a plurality of mounting rods 330 attached to a bottom side of the bump board 310, and a plurality of force-limiting resting rods 340 disposed perpendicular to, distributed along a longitudinal length of, and attached to, the first and the second mounting rods 330. In this retracted position, the plurality of force-limiting resting rods 340 come to rest on the first and the second angle members 520 of the lateral pivoting assembly, which are attached to the hollow frame assembly that is itself secured to the street or roadway 110. When in this refracted position, if a vehicle (100 of FIG. 1A) traverses the retractable speed barrier system 200, the weight and force exerted by the vehicle is distributed from the bump board 310, mounting rods 330, and force-limiting resting rods 340 to the first and the second angle members 520 and to the hollow frame assembly that is secured to the street or roadway 110. Activation system 700 may include a detection system 710 (not independently illustrated) configured to detect a speed of an oncoming vehicle (100 of FIG. 1) at a predetermined distance, an optional speed display 720 configured to display a detected speed of the oncoming vehicle (100 of FIG. 1) at the predetermined distance, and an optional alert display 730 configured to display a predetermined message advising drivers of the state of the system 200. Activation system 700 may trigger a linear actuator 610 used to laterally pivot the winged speed barrier assembly on a plurality of trapezoidal hinges 510 in a direction perpendicular to the flow of traffic between a retracted position and a deployed position. One of ordinary skill in the art will recognize that one or more signals from activation system 700 may be used to trigger the linear actuator 610 in accordance with one or more embodiments of the present invention.

Figure 2B:
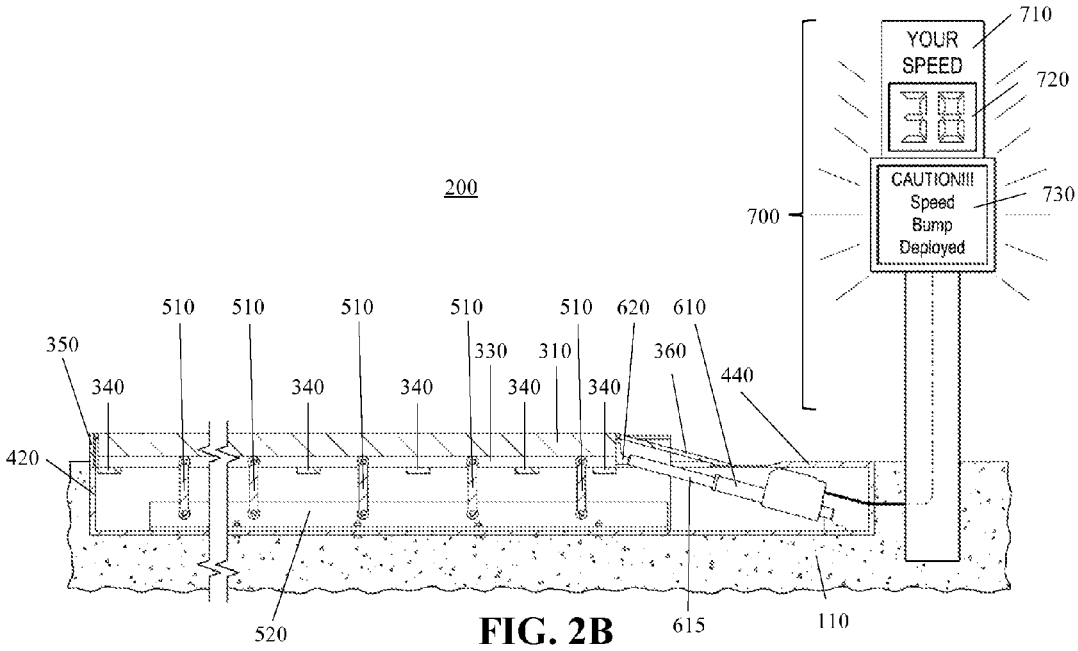
FIG. 2B shows a cross-sectional longitudinal view of the retractable speed barrier system in a deployed position in accordance with one or more embodiments of the present invention.

Continuing in FIG. 2B, a cross-sectional longitudinal view of the retractable speed barrier system 200 in a deployed position is shown in accordance with one or more embodiments of the present invention. In the example depicted, activation system 700 determines, by way of detection system 710, that the oncoming vehicle (100 of FIG. 1B) is approaching the retractable speed barrier system 200 at a speed of 38 MPH that exceeds a hypothetical predetermined speed at a predetermined distance in this instance. The activation system 700 displays the oncoming vehicle's (100 of FIG. 1) speed on the optional speed display 720, deploys the retractable speed barrier system 200, and provides the driver with an alert on the optional alert display 730 advising that the system 200 is deployed. Activation system 700 deploys the retractable speed barrier system 200 by sending one or more electrical signals to linear actuator 610. Linear actuator 610 includes an actuating rod 615 coupled to a contact pad 620 that is itself coupled to a distal end of the bump board 310. When the linear actuator 610 is actuated, actuating rod 615 exerts force on the bump board 310 and causes the bump board 310 to laterally pivot from the retracted, or inactive, position to the deployed position. The bump board 310 laterally pivots on a plurality of trapezoidal hinges 510, in a direction perpendicular to the flow of traffic, to a final deployed position where the plurality of trapezoidal hinges 510 are vertically oriented in the deployed position and the winged speed barrier assembly comes to rest against the first distal end plate 350 and the first distal end sidewall member 420 of the hollow frame assembly. The linear actuator 610 can be reset to retract the winged speed barrier assembly and restore the retractable speed barrier system 200 to the retracted, or inactive, position as shown in FIG. 2A.

Figure 3A:
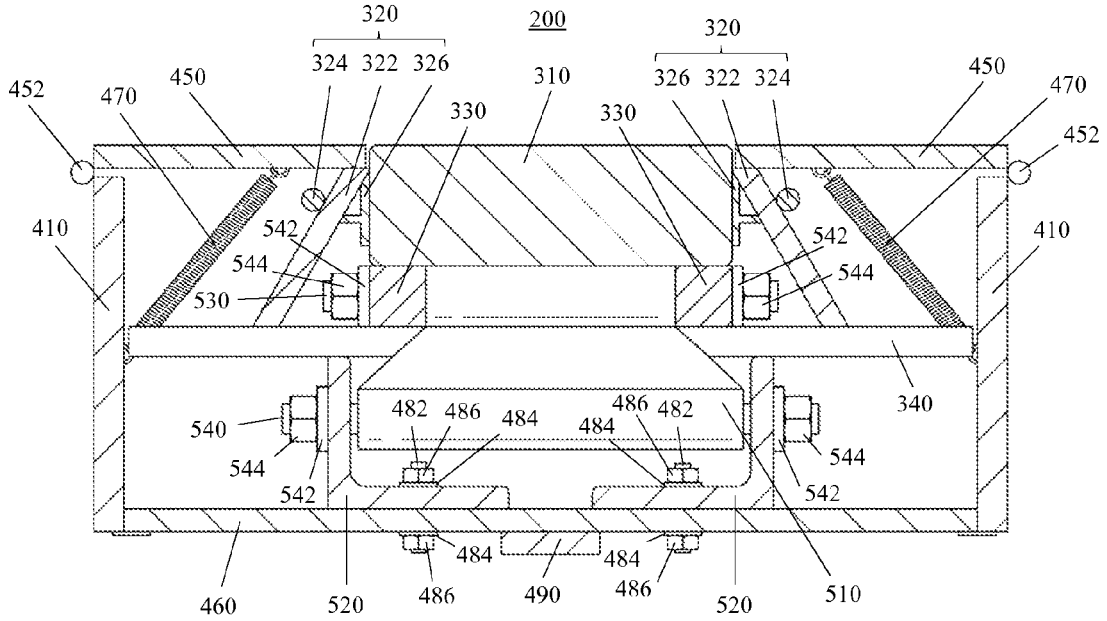
FIG. 3A shows a cross-sectional distal end view of a retractable speed barrier system in a retracted position in accordance with one or more embodiments of the present invention.

FIG. 3A shows a cross-sectional distal end view of a retractable speed barrier system 200 in a retracted position in accordance with one or more embodiments of the present invention. The winged speed barrier assembly may include a bump board 310, a first mounting rod 330 attached to a first longitudinal edge of a bottom side of the bump board 310, a second mounting rod 330 attached to a second longitudinal edge of the bottom side of the bump board 310, a first strike plate 320 attached to a first longitudinal sidewall of the bump board 310, a second strike plate 320 attached to a second longitudinal sidewall of the bump board 310, a first distal slide plate (350 of FIG. 2) attached to a first distal end sidewall of the bump board 310, a second distal slide plate (360 of FIG. 2) attached to a second distal end sidewall of the bump board 310, and a plurality of force-limiting resting rods 340 disposed perpendicular to, distributed along a longitudinal length of, and attached to, the first mounting rod 330 and the second mounting rod 330. The first and the second strike plates 320 may each include a support plate 322, a contact support member 326 attached to a first side of the support plate 322, and a cylindrical support member 324 attached to a second side of the support plate 322. Each contact support member 326 may be attached to a respective longitudinal sidewall of the bump board 310 and a top portion of each support plate 322 may be attached to a respective longitudinal sidewall of the bump board 310 and a bottom portion of each support plate 322 may be attached to the top surfaces of the plurality of force-limiting resting rods 340.

The lateral pivoting assembly may include a plurality of trapezoidal hinges 510, a first angle member 520, a second angle member 520, a plurality of first removable hinge pins 530, a plurality of second removable hinge pins 540, a plurality of washers 542, and a plurality of hinge pin nuts 544. The hollow frame assembly may include a first longitudinal sidewall member 410, a second longitudinal sidewall member 410, a first distal end sidewall member (420 of FIG. 2) connecting the first and the second longitudinal sidewall members 410 at the first distal end, a plurality of second distal end sidewall members (not shown) and a control box (440 of FIG. 2) connecting the first and the second longitudinal sidewall members 410 at the second distal end, a plurality of sidewall support braces 460 disposed within, perpendicular to, distributed along a longitudinal length of, and attached to, an interior face of the first and the second longitudinal sidewall members 410, a first longitudinal slide plate 450 attached to a longitudinal edge of the first longitudinal sidewall member 410 by a first plurality of hinge brackets 452, a second longitudinal slide plate 450 attached to a longitudinal edge of the second longitudinal sidewall member 410 by a second plurality of hinge brackets 452, a first plurality of springs 470 connecting the first longitudinal slide plate 450 to the first longitudinal sidewall member 410, a second plurality of springs 470 connecting the second longitudinal slide plate 450 to the first longitudinal sidewall member 410, and a center support brace 490 that runs a longitudinal length of the underside of the hollow frame assembly.

The hollow frame assembly may be partially or wholly assembled in advance offsite and disposed in a channel cut in a street or roadway (110 of FIG. 1) during installation. Advantageously, no special tools are required and any tool capable of cutting a channel in asphalt, concrete, or cement such as, for example, a concrete saw may be used. The winged speed barrier assembly and the lateral pivoting assembly may be partially assembled in advance and connected to the hollow frame assembly after disposing the hollow frame assembly in the channel cut in the street or roadway (110 of FIG. 1). For example, the first angle member 520 may be secured to the plurality of sidewall support braces 460 by a plurality of double ended threaded studs 482, a plurality of washers 484, and a plurality of nuts 486. Similarly, the second angle member 520 may be secured to the plurality of sidewall support braces 460 by a plurality of double ended threaded studs 482, a plurality of washers 484, and a plurality of nuts 486. A plurality of trapezoidal hinges 510 may be secured to the first angle member 520 and the second angle member 520 by the second plurality of removable hinge pins 540, the plurality of washers 542, and the plurality of hinge pin nuts 544.

In certain embodiments, the channel cut in the street or roadway (110 of FIG. 1) may be at least twice the width of the hollow frame assembly. The hollow frame assembly may then be secured to the bottom and sidewalls, or interior faces, of the channel cut into the street or roadway (110 of FIG. 1) using any mechanism suitable for doing so. One of ordinary skill in the art will recognize that the size of the channel may scale with a size of a retractable speed barrier system 200 or otherwise vary in accordance with one or more embodiments of the present invention. In certain embodiments, an installer may securely attach a plurality of rebar pins or other structural elements (not shown) to the outer walls of the hollow frame assembly (not shown), dispose the hollow frame assembly with the plurality of rebar pins in the channel, and then pour asphalt, concrete, cement, or other binding material (not shown) to fill in the area between the sidewalls, or outer edges, of the channel cut into the street or roadway and the outer sidewalls of the hollow frame assembly. In doing so, the structural integrity of the hollow frame assembly is strengthened when the retractable speed barrier system 200 is deployed. For example, when the system 200 is deployed and a vehicle (100 of FIG. 1) tire strikes the deployed winged bump board assembly, the force-limiting resting rods 340 may contact the inner walls of the hollow frame assembly and transfer energy laterally across the entire winged bump board assembly, ultimately down to, and through, the force-limiting resting rods 340 which interact with the inner walls of the hollow frame assembly that are themselves structurally reinforced by the asphalt, concrete, cement, or other binding material (not shown) that maintains the structural integrity of the hollow frame assembly. In other embodiments, the hollow frame assembly may be secured in the channel by epoxy anchors (not shown). One of ordinary skill in the art will recognize that any other mechanism for securing the hollow frame assembly to the channel, or combinations of mechanisms thereof, may be used in accordance with one or more embodiments of the present invention. Once the system 200 is installed, asphalt, concrete, cement, or other binding material (not shown) may be used to flood the bottom of the hollow frame assembly, filling the hollow frame assembly to a level just below the moving parts of the lateral pivoting assembly, and further securing the hollow frame assembly, and system 200 in general, to the channel cut into the street or roadway (110 of FIG. 1).

Figure 3B:
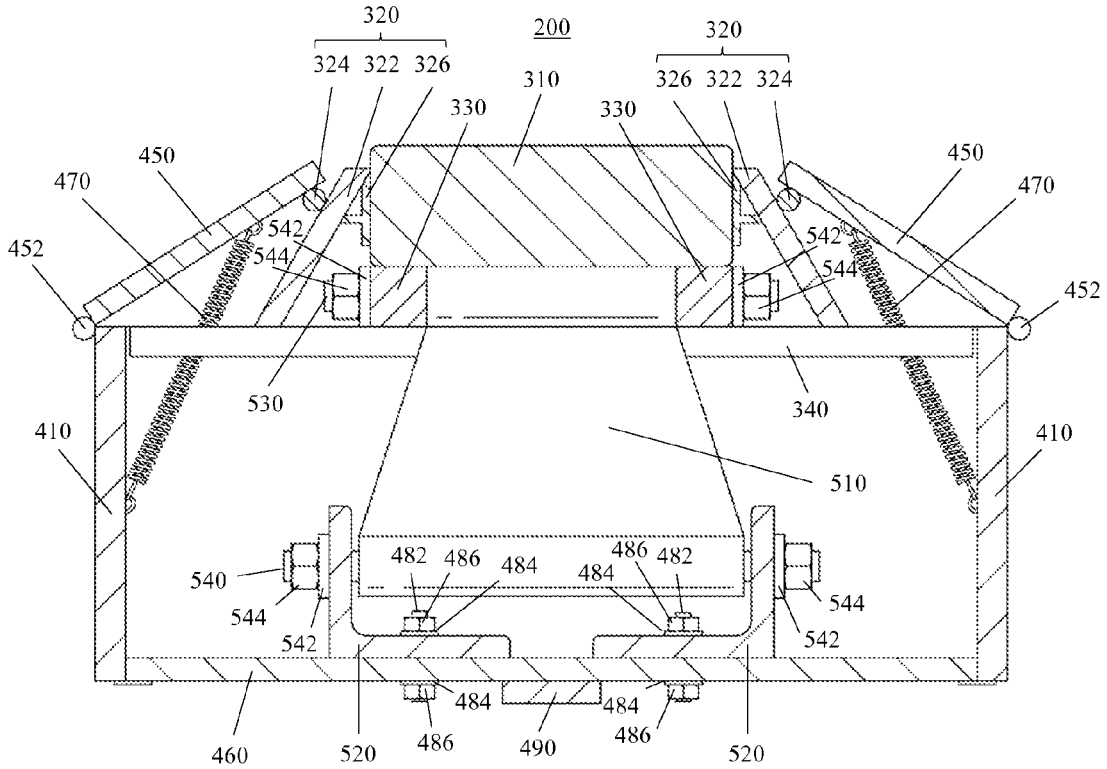
FIG. 3B shows a cross-sectional distal end view of the retractable speed barrier system in a deployed position in accordance with one or more embodiments of the present invention.

Continuing in FIG. 3B, a cross-sectional distal end view of the retractable speed barrier system 200 in a deployed position is shown in accordance with one or more embodiments of the present invention. When the activation system (700 of FIGS. 1 and 2) triggers the retractable speed barrier system 200, a linear actuator (610 of FIG. 2) actuates an actuating rod (615 of FIG. 2) that is coupled to a contact pad (620 of FIG. 2) that is itself coupled to a distal end of the bump board 310. When the linear actuator (610 of FIG. 2) is actuated, the actuating rod (615 of FIG. 2) exerts force on the bump board 310 and causes the winged speed barrier assembly, including bump board 310, to laterally pivot from the retracted, or inactive, position to the deployed position. The entire winged speed barrier assembly, including the bump board 310, laterally pivots on the plurality of trapezoidal hinges 510 in a direction perpendicular to the flow of traffic until the trapezoidal hinges 510 are vertical and the first distal end of the winged speed barrier assembly comes to rest against the first distal end plate (350 of FIG. 2) and the first distal end sidewall member (420 of FIG. 2) of the hollow frame assembly as shown in FIG. 2B. As the winged speed barrier assembly laterally pivots from the retracted position to the deployed position, the winged speed barrier assembly rises in a lateral manner and the first and the second strike plates 320 cause the first and the second longitudinal slide plates 450 to open under spring 470 tension. In the deployed position, the first and the second longitudinal slide plates 450 and the winged speed barrier assembly form a substantially trapezoidal-shaped bump above the surface of the street or roadway (110 of FIG. 1), constituting a vertical deflection. In certain embodiments, the vertical deflection may be approximately 3". One of ordinary skill in the art will recognize that the amount of vertical deflection may vary based on an application or design in accordance with one or more embodiments of the present invention. When an oncoming vehicle (100 of FIG. 1) traverses the deployed retractable speed barrier system 200, the weight and force exerted by the vehicle is distributed from the winged speed barrier assembly bump board 310 to the mounting rods 330 and the vertically oriented plurality of trapezoidal hinges 510 to the first and the second angle members 520 and to the hollow frame assembly that is secured to the street or roadway (110 of FIG. 1). In addition, the first and the second longitudinal slide plates 450 may provide access to the retractable speed barrier system 200 for service and/or maintenance.

Figure 4:
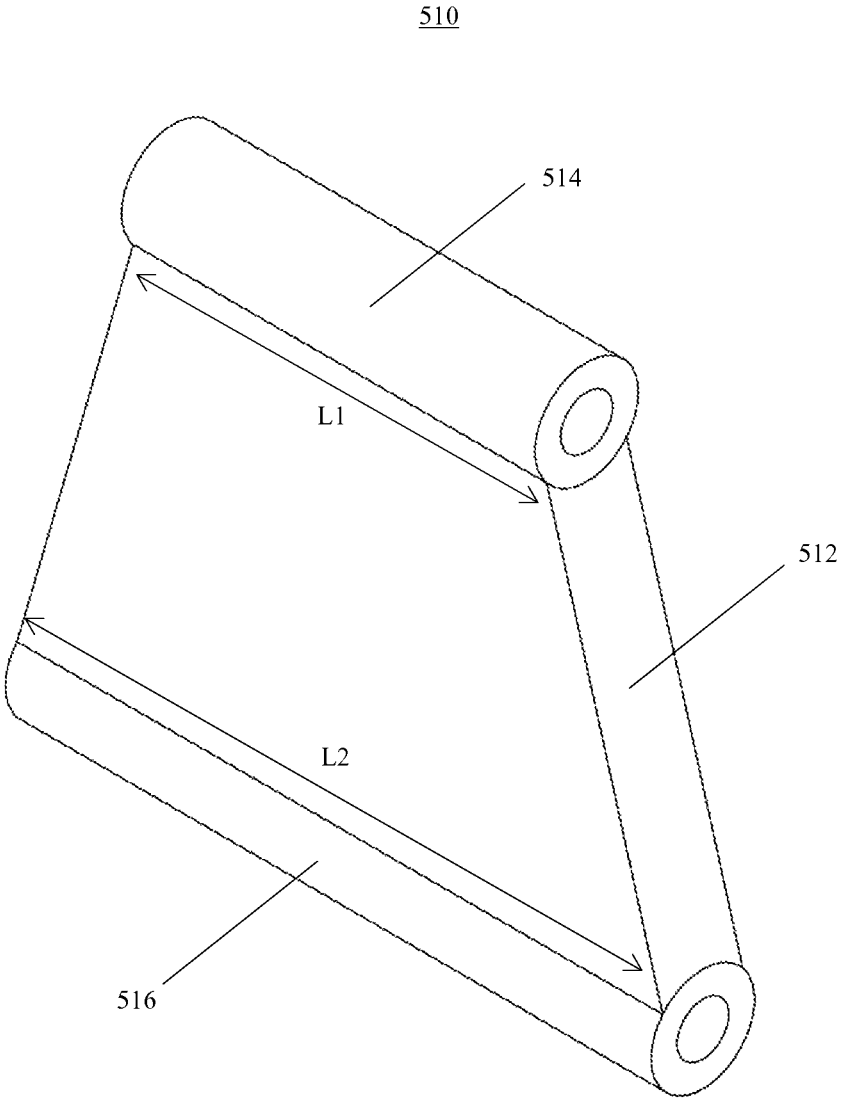
FIG. 4 shows a perspective view of a trapezoidal hinge in accordance with one or more embodiments of the present invention.

FIG. 4 shows a perspective view of a trapezoidal hinge 510 in accordance with one or more embodiments of the present invention. Trapezoidal hinge 510 may include a trapezoid-shaped support plate 512 having a first base with a first length, L1, and a second base with a second length, L2, longer than the first length, L1. Trapezoidal hinge 510 may include a first hollow cylindrical barrel having the first length and configured to receive a first removable hinge pin (530 of FIG. 3) that is attached to a distal end of first base of the trapezoid-shaped support plate 512 and a second hollow cylindrical barrel having the second length and configured to receive a second removable hinge pin (540 of FIG. 3) that is attached to a distal end of the second base of the trapezoid-shaped support plate 512. In certain embodiments, trapezoid-shaped support plate 512 may have a first base having a length, L1, of approximately 4" and a second base having a length, L2, of approximately 6". One of ordinary skill in the art will recognize that the lengths of the first base and the second base may vary based on an application or design in accordance with one or more embodiments of the present invention. In certain embodiments, trapezoidal hinge 510 may be composed of A36 flat steel. One of ordinary skill in the art will recognize that trapezoidal hinge 510 may be composed of other metals or metal alloys, the selection of which may vary based on an application or design, in accordance with one or more embodiments of the present invention.

Figure 5:
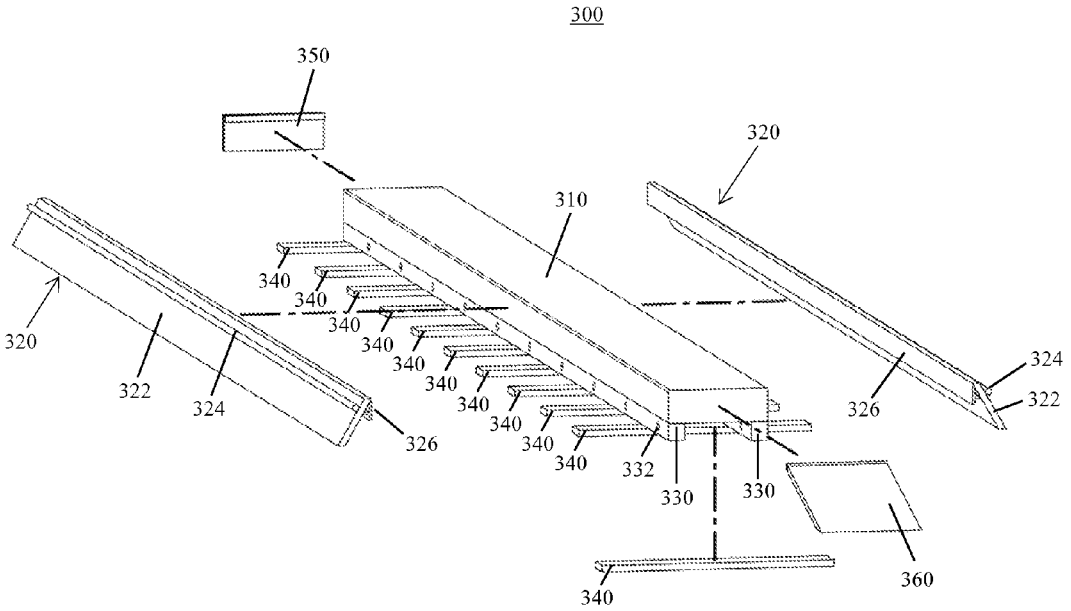
FIG. 5 shows an exploded view of a winged speed barrier assembly of a retractable speed barrier system in accordance with one or more embodiments of the present invention.

FIG. 5 shows an exploded view of a winged speed barrier assembly 300 of a retractable speed barrier system 200 in accordance with one or more embodiments of the present invention. As discussed above, winged speed barrier assembly 300 may include a bump board 310, a first mounting rod 330 attached to a first longitudinal edge of a bottom side of the bump board 310, a second mounting rod 330 attached to a second longitudinal edge of the bottom side of the bump board 310, a first strike plate 320 attached to a first longitudinal sidewall of the bump board 310, a second strike plate 320 attached to a second longitudinal sidewall of the bump board 310, a first distal slide plate 350 attached to a first distal end sidewall of the bump board 310, a second distal slide plate 360 attached to a second distal end sidewall of the bump board 310, and a plurality of force-limiting resting rods 340 disposed perpendicular to, distributed along a longitudinal length of, and attached to, the first mounting rod 330 and the second mounting rod 330. The first and the second strike plates 320 may each include a support plate 322, a contact support member 326 attached to a first side of the support plate 322, and a cylindrical support member 324 attached to a second side of the support plate 322. Each contact support member 326 may be attached to a longitudinal sidewall of the bump board 310. In certain embodiments, the various components of the winged speed barrier assembly 300 may be attached by welded joints. One of ordinary skill in the art will recognize that any other suitable means of attachment may be used in accordance with one or more embodiments of the present invention.

In certain embodiments, the bump board 310 may be a hollow box member, substantially rectangular in shape, and composed of carbon steel having a wall thickness of approximately 5/16". One of ordinary skill in the art will recognize that bump board 310 may be composed of other metals or metal alloys which may vary based on an application or design in accordance with one or more embodiments of the present invention. In addition, one of ordinary skill in the art will also recognize that the shape, composition, and/or thickness may vary based on an application or design in accordance with one or more embodiments of the present invention to achieve desired strength and weight characteristics. In certain embodiments, the bump board 310 may have dimensions of approximately 6" in width by approximately 2" in height with a length that varies based on an application or design. In typical applications, the length may be, for example, at least 8', sufficient to cover a substantial driving portion of a given lane of a street or roadway (110 of FIG. 1). One of ordinary skill in the art will recognize that the dimensions of the bump board 310 may vary based on an application or design in accordance with one or more embodiments of the present invention.

In certain embodiments, the first and the second mounting rods 330 may be solid members, substantially square cuboid in shape, and composed of steel. One of ordinary skill in the art will recognize that the first and the second mounting rods 330 may be composed of other metals or metal alloys which may vary based on an application or design in accordance with one or more embodiments of the present invention. In addition, one or ordinary skill in the art will also recognize that the shape and composition may vary based on an application or design in accordance with one or more embodiments of the present invention. The first and the second mounting rods 330 may include a plurality of holes 332 disposed in the longitudinal sidewalls of the first and the second mounting rods 330 to accommodate the first removable hinge pins (530 of FIG. 3), that are drilled in between the locations of the plurality of force-limiting resting rods 340. In certain embodiments, the first and the second mounting rods 330 may have dimensions of approximately 1" in width by approximately 1" in height with a length that varies based on an application or design, but typically similar to the length of the bump board 310 to which it is attached. For example, if the bump board is approximately 8' in length, the first and the second mounting rods 330 may be approximately 8' in length as well. One of ordinary skill in the art will recognize that the dimensions of the first and the second mounting rods 330 may vary based on an application or design in accordance with one or more embodiments of the present invention.

In certain embodiments, the plurality of force-limiting resting rods 340 may be hollow box members, substantially rectangular in shape, and composed of steel having a wall thickness of approximately 5/16". One of ordinary skill in the art will recognize that the plurality of force-limiting resting rods 340 may be composed of other metals or metal alloys which may vary based on an application or design in accordance with one or more embodiments of the present invention. In addition, one or ordinary skill in the art will also recognize that the shape, composition, and/or thickness may vary based on an application or design in accordance with one or more embodiments of the present invention. In certain embodiments, the plurality of force-limiting resting rods 340 may have dimensions of approximately 2" in width by approximately ½" in height by approximately 14" in length. One of ordinary skill in the art will recognize that the dimensions of the force-limiting resting rods 340 may vary based on an application or design in accordance with one or more embodiments of the present invention.

In certain embodiments, the first and the second strike plates 320 may be composed of carbon steel having a thickness of approximately 5/16". One of ordinary skill in the art will recognize that the first and the second strike plates 320 may be composed of other metals or metal alloys which may vary based on an application or design in accordance with one or more embodiments of the present invention. In addition, one or ordinary skill in the art will also recognize that the shape, composition, and/or thickness may vary based on an application or design in accordance with one or more embodiments of the present invention. In certain embodiments, the first and the second strike plates 320 may have dimensions of approximately 2½" in width by approximately ⅜" in height with a length that varies based on an application or design, but typically similar to the length of the bump board 310 to which it is attached. For example, if the bump board is approximately 8' in length, the first and the second mounting rods 330 may be approximately 8' in length as well. One of ordinary skill in the art will recognize that the dimensions of the first and the second strike plates 320 may vary based on an application or design in accordance with one or more embodiments of the present invention.

In certain embodiments, the first distal slide plate 350 may be a substantially rectangular member composed of steel having a thickness of approximately ⅜". One of ordinary skill in the art will recognize that the first distal slide plate 350 may be composed of other metals or metal alloys which may vary based on an application or design in accordance with one or more embodiments of the present invention. In addition, one or ordinary skill in the art will also recognize that the shape, composition, and/or thickness may vary based on an application or design in accordance with one or more embodiments of the present invention. In certain embodiments, the first distal slide plate 350 may have dimensions of approximately 3" in width by approximately 6" in length, where the length may vary based on an application or design. For example, the first distal slide plate 350 may have a length sufficient to cover the gap between the edge of the bump board 310 and the edge of the hollow frame assembly. One of ordinary skill in the art will recognize that the dimensions of the first distal slide plate 350 may vary based on an application or design in accordance with one or more embodiments of the present invention.

In the retracted position, the first distal slide plate (350 of FIG. 2A) may ensure that the top surface of the retractable barrier system (200 of FIG. 2A) is substantially flush with the grade of the street or roadway (110 of FIG. 1), prevents unwanted debris from entering the hollow frame assembly, and restricts pedestrians, especially children, from purposefully or inadvertently inserting anything into the cavity of the hollow frame assembly. Other such safeguards may be used in similar areas where an opening might be shown to exist, even if not specifically illustrated herein. In the deployed position, the first distal slide plate (350 of FIG. 2B) pivots on a hinge bracket (not independently illustrated) to an upright vertical orientation such that the deployed winged speed barrier assembly comes to rest against the first distal end plate 350 and the first distal end sidewall member (420 of FIG. 2B) of the hollow frame assembly.

In certain embodiments, the second distal slide plate 360 may be a substantially rectangular member composed of steel having a thickness of at least ½". One of ordinary skill in the art will recognize that the second distal slide plate 360 may be composed of other metals or metal alloys which may vary based on an application or design in accordance with one or more embodiments of the present invention. In addition, one or ordinary skill in the art will also recognize that the shape, composition, and/or thickness may vary based on an application or design in accordance with one or more embodiments of the present invention. In certain embodiments, the second distal slide plate 360 may have dimensions of approximately 6" in width by approximately 10" in length. One of ordinary skill in the art will recognize that the dimensions of the second distal slide plate 360 may vary based on an application or design in accordance with one or more embodiments of the present invention.

In the retracted position, the second distal slide plate (360 of FIG. 2A) ensures that the top surface of the retractable barrier system (200 of FIG. 2A) is substantially flush with the grade of the street, prevents unwanted debris from entering the hollow frame assembly, and restricts pedestrians, especially children, from purposefully or inadvertently inserting anything into the cavity of the hollow frame assembly including, for example, the control box (440 of FIG. 2B). In the deployed position, the second distal slide plate (360 of FIG. 2B) pivots on a hinge bracket (not independently illustrated) to accommodate the increase in height resulting from actuation of the linear actuator (610 of FIG. 2B).

Figure 6:
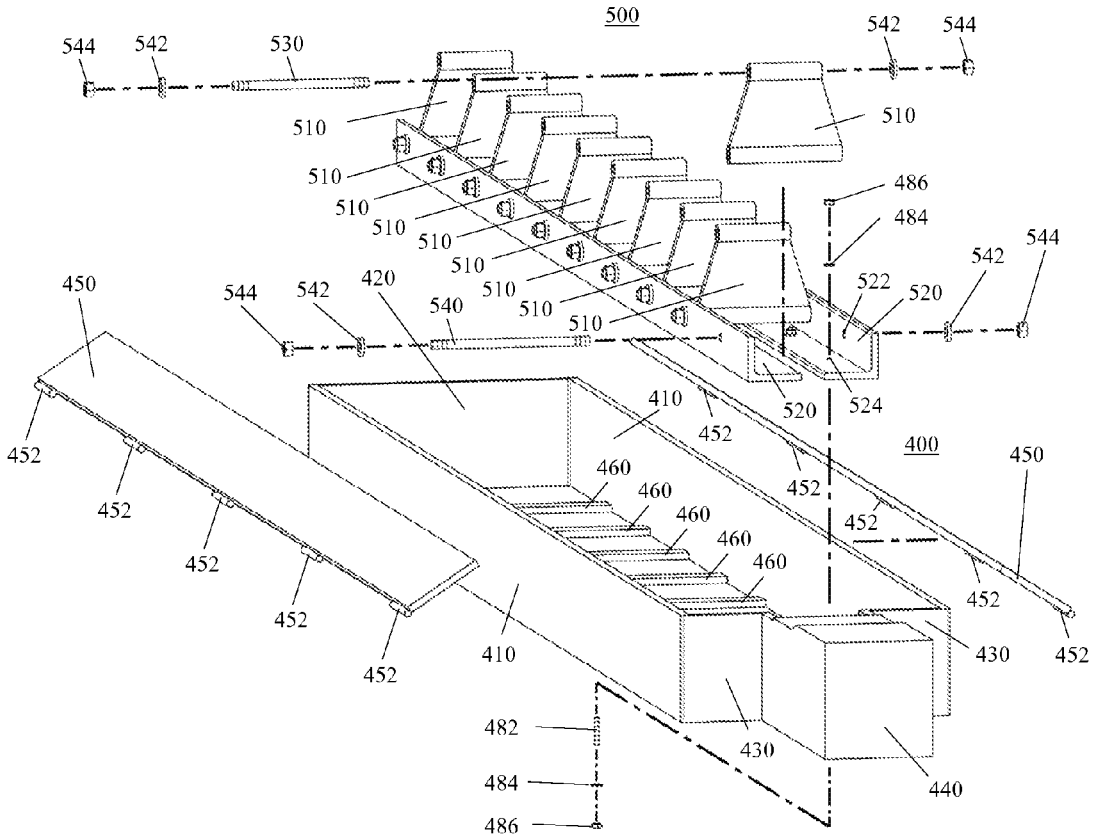
FIG. 6 shows an exploded view of a lateral pivoting assembly and a hollow frame assembly of a retractable speed barrier system in accordance with one or more embodiments of the present invention.

FIG. 6 shows an exploded view of a lateral pivoting assembly 500 and a hollow frame assembly 400 of a retractable speed barrier system 200 in accordance with one or more embodiments of the present invention. As discussed above, the lateral pivoting assembly 500 may include a plurality of trapezoidal hinges 510, a first angle member 520, a second angle member 520, a plurality of first removable hinge pins 530, a plurality of second removable hinge pins 540, a plurality of washers 542, and a plurality of hinge pin nuts 544. As a load bearing member, the number of trapezoidal hinges 510 used may vary based on an application or design. In certain embodiments, a trapezoidal hinge 510 may be used for each 8" of length of the winged speed barrier assembly (300 of FIG. 5). One of ordinary skill in the art will recognize that the number, or density, of trapezoidal hinges 510 per unit length of the winged speed barrier assembly (300 of FIG. 5) may vary based on an application or design to achieve a desired strength and weight bearing capability in accordance with one or more embodiments of the present invention.

In certain embodiments, the first and the second angle members 520 may be L-shaped members composed of steel having a thickness of approximately ⅜". One of ordinary skill in the art will recognize that the first and the second angle members 520 may be composed of other metals or metal alloys which may vary based on an application or design in accordance with one or more embodiments of the present invention. In addition, one or ordinary skill in the art will also recognize that the shape, composition, and/or thickness may vary based on an application or design in accordance with one or more embodiments of the present invention. In certain embodiments, the first and the second angle members 520 may have dimensions of approximately 3" in width by approximately 3" in height with a length that may vary based on an application or design, but typically similar in length to the interior of the hollow frame assembly 400 to which it is attached. For example, if the bump board 310 is approximately 8' in length, the first and the second angle members 520 may be approximately 8' in length as well. One of ordinary skill in the art will recognize that the dimensions of the first and the second angle members 520 may vary based on an application or design in accordance with one or more embodiments of the present invention. The first and the second angle members 520 may include a plurality of holes 522 through which the second plurality of hinge pins 540 may be disposed to secure the plurality of trapezoidal hinges 510 in place with a plurality of washers 542 and a plurality of hinge pin nuts 544.

The hollow frame assembly 400 may include a first longitudinal sidewall member 410, a second longitudinal sidewall member 410, a first distal end sidewall member 420 connecting the first and the second longitudinal sidewall members 410 at the first distal end, a plurality of second distal end sidewall members 430 and a control box 440 connecting the first and the second longitudinal sidewall members 410 at the second distal end, a plurality of sidewall support braces 460 disposed within, perpendicular to, distributed along a longitudinal length of, and attached to, the interior faces of the first and the second longitudinal sidewall members 410, a first longitudinal slide plate 450 attached to a longitudinal edge of the first longitudinal sidewall member 410 by a first plurality of hinge brackets 452, a second longitudinal slide plate 450 attached to a longitudinal edge of the second longitudinal sidewall member 410 by a second plurality of hinge brackets 452, a first plurality of springs (470 of FIG. 3) connecting the first longitudinal slide plate 450 to the first longitudinal sidewall member 410, and a second plurality of springs (470 of FIG. 3) connecting the second longitudinal slide plate 450 to the first longitudinal sidewall member 410.

In certain embodiments, the first and the second longitudinal sidewall members 410 may be substantially rectangular members composed of steel having a thickness of approximately 5/16". One of ordinary skill in the art will recognize that the first and the second longitudinal sidewall members 410 may be composed of other metals or metal alloys which may vary based on an application or design in accordance with one or more embodiments of the present invention. In addition, one or ordinary skill in the art will also recognize that the shape, composition, and/or thickness may vary based on an application or design in accordance with one or more embodiments of the present invention. In certain embodiments, the first and the second longitudinal sidewall members 410 may have dimensions of approximately 6" in width by approximately 8' 6" in length, where the length may vary based on an application or design. For example, if the bump board 310 is approximately 8 feet in length, the first and the second longitudinal sidewall members 410 may be approximately 8' 6" in length. One of ordinary skill in the art will recognize that the dimensions of the first and the second longitudinal sidewall members 410 may vary based on an application or design in accordance with one or more embodiments of the present invention.

In certain embodiments, the first distal end sidewall member 420 may be a substantially rectangular member composed of steel having a thickness of approximately 5/16". One of ordinary skill in the art will recognize that the first distal end sidewall member 420 may be composed of other metals or metal alloys which may vary based on an application or design in accordance with one or more embodiments of the present invention. In addition, one or ordinary skill in the art will also recognize that the shape, composition, and/or thickness may vary based on an application or design in accordance with one or more embodiments of the present invention. In certain embodiments, the first distal end sidewall member 420 may have dimensions of approximately 6" in width by approximately 15" in length. One of ordinary skill in the art will recognize that the dimensions of the first distal end sidewall member 420 may vary based on an application or design in accordance with one or more embodiments of the present invention. The first distal end sidewall member 420 may attach to the first longitudinal sidewall member 410 to the second longitudinal sidewall member 410 at the first distal end. In certain embodiments, the first distal end sidewall member 420 may attached to the first and the second longitudinal sidewall members 410 by weld joints. One of ordinary skill in the art will recognize that any other suitable methods of attachment may be used in accordance with one or more embodiments of the present invention.

In certain embodiments, the plurality of second distal end sidewall members 430 and control box 440 may be composed of steel having a thickness of approximately 5/16". One of ordinary skill in the art will recognize that the plurality of second distal end sidewall members 430 and control box 440 may be composed of other metals or metal alloys which may vary based on an application or design in accordance with one or more embodiments of the present invention. In addition, one or ordinary skill in the art will also recognize that the shape, composition, and/or thickness may vary based on an application or design in accordance with one or more embodiments of the present invention. In certain embodiments, the plurality of second distal end sidewall members 430 may have dimensions of approximately 4½" in width by approximately 6" in length and the control box 440 may have dimensions of approximately 6" in width by approximately 6" in height by approximately 17" in length. One of ordinary skill in the art will recognize that the dimensions of the plurality of second distal end sidewall members 430 and control box 440 may vary based on an application or design in accordance with one or more embodiments of the present invention. The first second distal end sidewall member 430 may attach to the first longitudinal sidewall member 410 and the control box 440 and the second distal end sidewall member 430 may be attached to the control box 440 and the second longitudinal sidewall member 410 at the second distal end. In certain embodiments, the plurality of second distal end sidewall members 430 may attach to the first and the second longitudinal sidewall members 410 and the control box 440 by weld joints. One of ordinary skill in the art will recognize that any other suitable methods of attachment may be used in accordance with one or more embodiments of the present invention.

In certain embodiments, the plurality of sidewall support braces 460 may be substantially rectangular members composed of steel having a thickness of approximately 5/16". One of ordinary skill in the art will recognize that the plurality of sidewall support braces 460 may be composed of other metals or metal alloys which may vary based on an application or design in accordance with one or more embodiments of the present invention. In addition, one or ordinary skill in the art will also recognize that the shape, composition, and/or thickness may vary based on an application or design in accordance with one or more embodiments of the present invention. In certain embodiments, each sidewall support brace 460 may have dimensions of approximately 2" in width by approximately 14⅜" in length. One of ordinary skill in the art will recognize that the dimensions of the plurality of sidewall support braces 460 may vary based on an application or design in accordance with one or more embodiments of the present invention. Although not shown in FIG. 6, a center support brace (490 of FIG. 3) runs the length of the underside of the hollow frame assembly 400 having dimensions of approximately 2" in width by approximately 10' in length having a thickness of approximately 5/16", however, the length and other dimensions may vary based on an application or design in accordance with one or more embodiments of the present invention. The center support brace (490 of FIG. 3) may be welded on the lateral edges to each point of contact with each sidewall support brace 460. The plurality of sidewall support braces 460 may attach to the interior faces of the first longitudinal sidewall member 410 to the second longitudinal sidewall member 410. In certain embodiments, the plurality of sidewall support braces 460 may be attached to the first and the second longitudinal sidewall members 410 by weld joints. One of ordinary skill in the art will recognize that any other suitable methods of attachment may be used in accordance with one or more embodiments of the present invention. Each of the sidewall support braces 460 have mounting holes (not independently illustrated, see FIG. 2) where a plurality of double ended threaded studs 482, a plurality of washers 484, and a plurality of nuts 486 may be used to secure the lateral pivoting assembly 500 to the hollow frame assembly 400.

Figure 7:
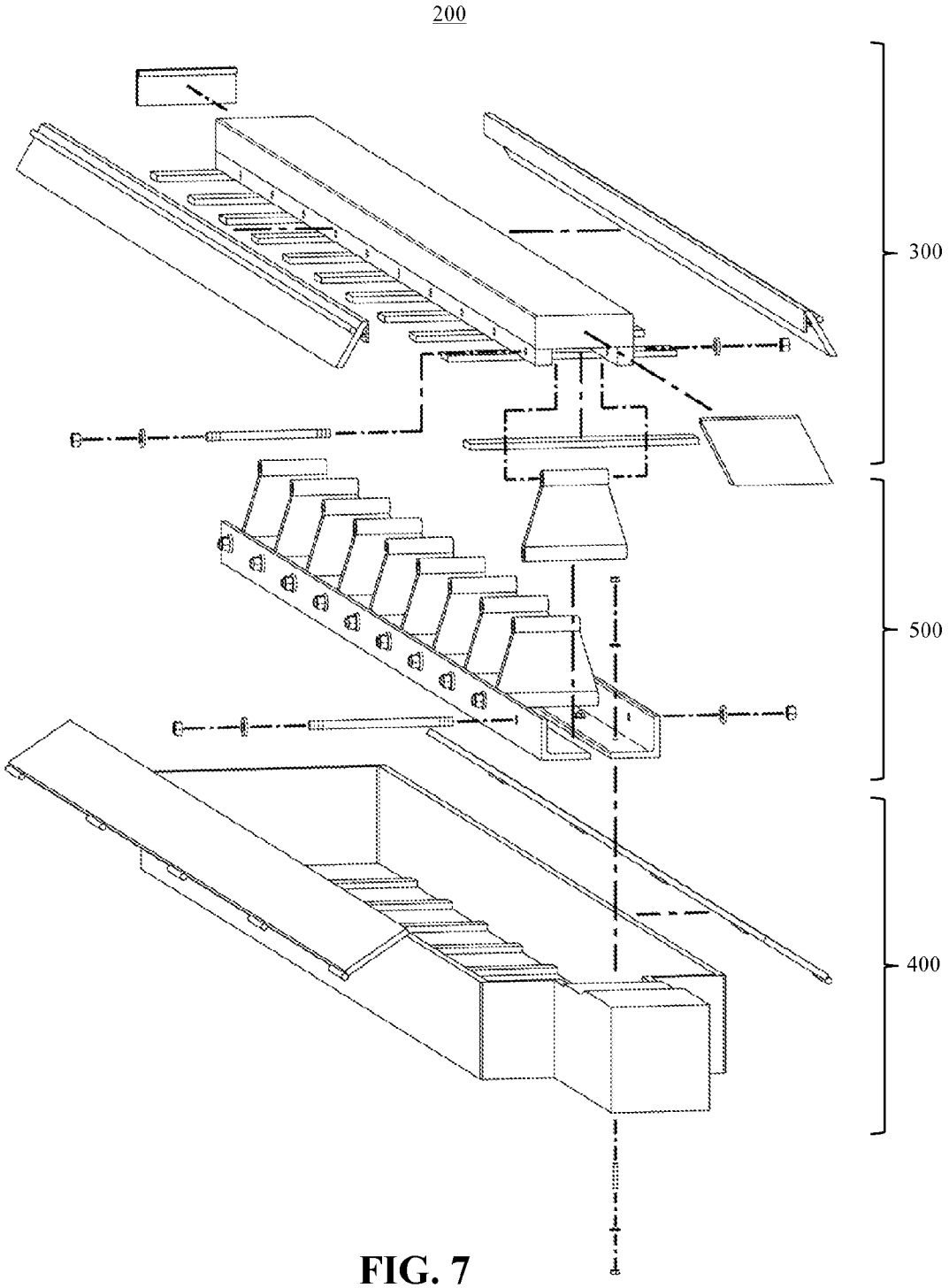
FIG. 7 shows an exploded view of a winged speed barrier assembly, lateral pivoting assembly, and hollow frame assembly of a retractable speed barrier system in accordance with one or more embodiments of the present invention.

FIG. 7 shows an exploded view of a winged speed barrier assembly 300, lateral pivoting assembly 500, and hollow frame assembly 400 of a retractable speed barrier system 200 in accordance with one or more embodiments of the present invention. In certain embodiments, the first and the second mounting rods (330 of FIG. 5) may be welded to the bottom side edges of the bump board (310 of FIG. 5). The first hollow cylindrical barrel (514 of Figure of FIG. 4) of each trapezoidal hinge (510 of FIG. 6) may be secured in place between the first and the second mounting rods (330 of FIG. 5) by a hinge pin (530 of FIG. 3), washers (542 of FIG. 3), and hinge pin nuts (544 of FIG. 3). Once all trapezoidal hinges (510 of FIG. 6) have been secured in place, the contact support members (326 of FIG. 3) may be welded to their respective sides of the bump board (310 of FIG. 5) followed by the support plates (322 of FIG. 3) which may be welded to the contact points on the side of the bump board (310 of FIG. 5), the contact points of the contact support members (326 of FIG. 3), and then to the top surfaces of the force-limiting resting rods (340 of FIG. 5). The cylindrical support members (324 of FIG. 3) are then welded to their respective support plates (322 of FIG. 3). The second hollow cylindrical barrel (516 of Figure of FIG. 4) of each trapezoidal hinge (510 of FIG. 6) may be secured to the first and the second angle members (520 of FIG. 3) by hinge pins (540 of FIG. 3), washers (542 of FIG. 3), and hinge pin nuts (544 of FIG. 3). The above-noted portion of the assembly process may take place at an offsite fabrication location prior to installation on site.

As noted above, the hollow frame assembly 400 may be partially or wholly assembled in advance and disposed in a channel (not shown) cut in a street or roadway (110 of FIG. 1). For example, in certain embodiments, the hollow frame assembly 400 may be secured to the bottom and sidewalls of the channel cut into the street or roadway (110 of FIG. 1) using any mechanism suitable for doing so. In certain embodiments, an installer may securely attach a plurality of rebar pins or other structural elements (not shown) to the outer walls (not independently illustrated) of the hollow frame assembly 400, dispose the hollow frame assembly 400 with the plurality of rebar pins (not shown) in the channel, and then pour asphalt, concrete, cement, or other binding material (not shown) to fill in the area between the sidewalls, or outer edges, of the channel cut in the street or roadway (110 of FIG. 1) and the outer sidewalls of the hollow frame assembly 400. In other embodiments, the hollow frame assembly 400 may be secured in the channel by epoxy anchors (not shown). One of ordinary skill in the art will recognize that any other mechanism for securing the hollow frame assembly 400 to the channel, or combinations of mechanisms thereof, may be used in accordance with one or more embodiments of the present invention.

Then the first and the second angle members (520 of FIG. 3) and components assembled thereto may be lowered onto the sidewall support braces (460 of FIG. 6) of the hollow frame assembly 400 and secured in place on the top side of double ended threaded studs (482 of FIG. 3) by washers (484 of FIG. 3) and nuts (486 of FIG. 3). Once secured in place, asphalt, concrete, cement, or other binding material (not shown) may be used to flood the bottom of the hollow frame assembly 400, filling the hollow frame assembly 400 to a level just below the moving parts of the lateral pivoting assembly 500, and further securing the hollow frame assembly 400 to the channel cut in the street or roadway (110 of FIG. 1). A linear actuator (610 of FIG. 2) may be disposed in the control box (440 of FIG. 6), connected to the bump board (310 of FIG. 2), and connected to a power source.

Figure 8A:
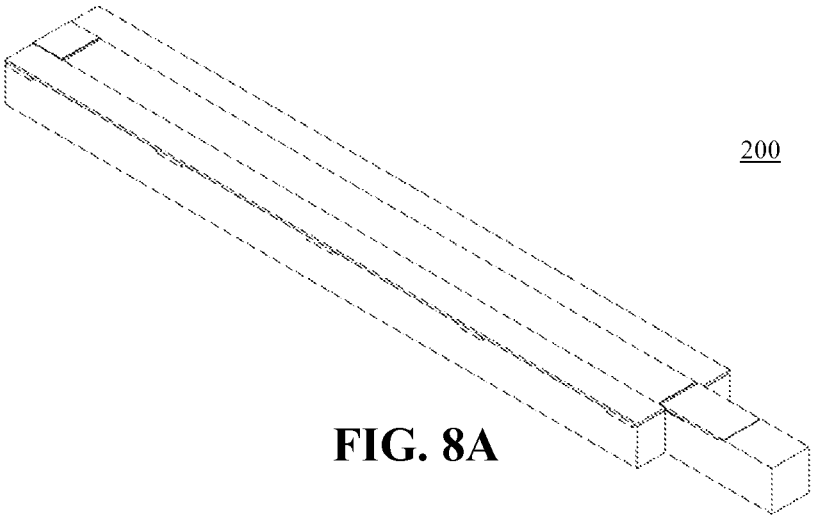
FIG. 8A shows a perspective view of a retractable speed barrier system in a retracted position in accordance with one or more embodiments of the present invention.
Figure 8B:
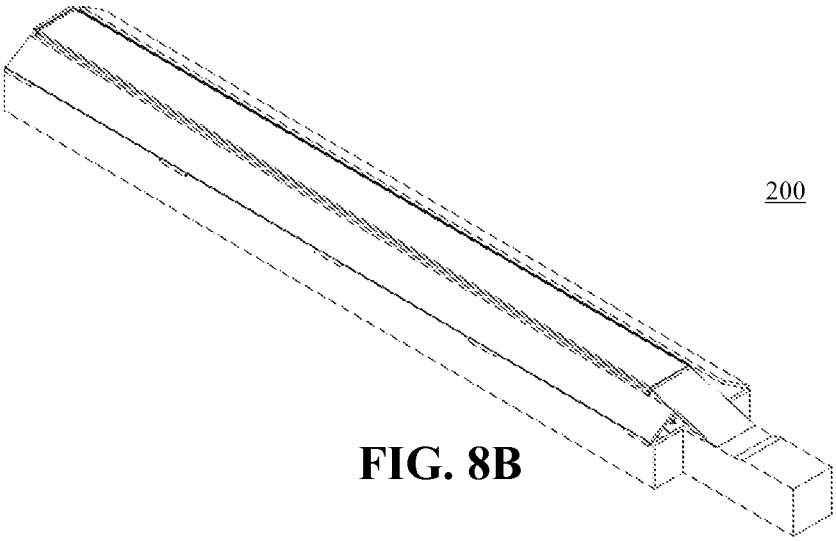
FIG. 8B shows a perspective view of the retractable speed barrier system in a deployed position in accordance with one or more embodiments of the present invention.
Figure 8C:
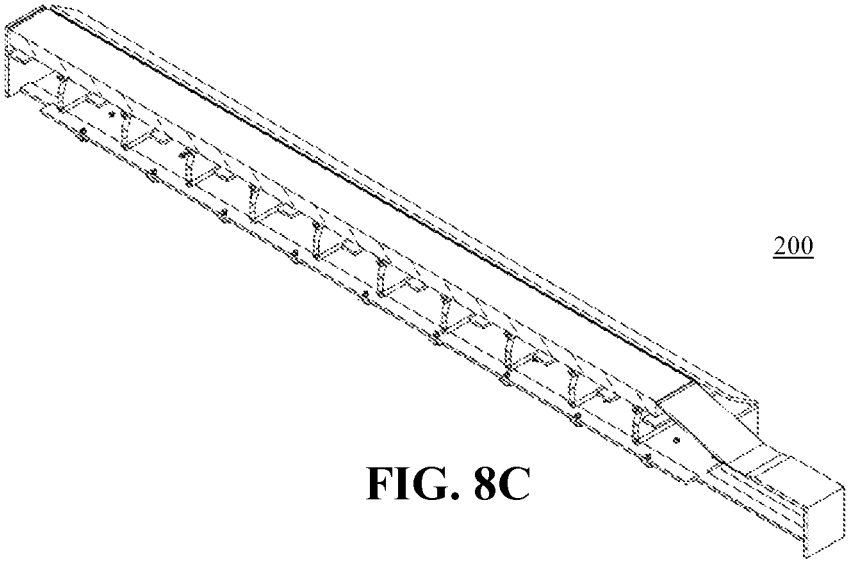
FIG. 8C shows a cross-sectional perspective view of the retractable speed barrier system in a deployed position in accordance with one or more embodiments of the present invention.

FIG. 8A shows a perspective view of a retractable speed barrier system 200 in a retracted position in accordance with one or more embodiments of the present invention. FIG. 8B shows a perspective view of a retractable speed barrier system 200 in a deployed position in accordance with one or more embodiments of the present invention. FIG. 8C shows a cross-sectional perspective view of a retractable speed barrier system 200 in a deployed position in accordance with one or more embodiments of the present invention.

Advantages of one or more embodiments of the present invention may include one or more of the following:

In one or more embodiments of the present invention, a retractable speed barrier system uses trapezoidal hinges that provide greater structural support than other lifting mechanisms. The strength of the system may be adjusted by modifying the width of each trapezoidal hinge or by increasing the number, or density, of trapezoidal hinges per length of the winged speed barrier assembly.

In one or more embodiments of the present invention, a retractable speed barrier system uses a lateral pivoting scheme that pivots the winged speed barrier assembly between a retracted position and a deployed position in a lateral manner that is perpendicular to the flow of traffic.

In one or more embodiments of the present invention, a retractable speed barrier system uses a lateral pivoting scheme that allows for faster retraction and deployment of the winged speed barrier assembly over conventional lifting schemes. The lateral pivoting motion requires substantially less force than conventional lifting schemes and the winged speed barrier assembly may be retracted or deployed in less than one second.

In one or more embodiments of the present invention, a retractable speed barrier system uses a lateral pivoting scheme that requires substantially fewer parts, is less complex, and more elegant than conventional lifting schemes that tend to be over-engineered. The lateral pivoting assembly does not require the use of highly engineered or precision manufactured components.

In one or more embodiments of the present invention, a retractable speed barrier system uses a lateral pivoting scheme that includes a plurality of trapezoidal hinges that are more structurally sound. The trapezoidal hinges distribute force more evenly to the frame assembly and can support more weight than conventional lifting schemes. The strength of the retractable speed barrier can be adjusted by modifying the number of trapezoidal hinges used per unit length of the winged speed barrier assembly.

In one or more embodiments of the present invention, a retractable speed barrier system can be quickly and easily installed in an existing road and repaired in situ.

In one or more embodiments of the present invention, a retractable speed barrier system provides a more compact design in a smaller footprint that is modular. The winged speed barrier assembly, lateral pivoting assembly, and hollow frame assembly can be substantially assembled prior to installation on site allowing for fast and efficient install. Because of the modular design, if an aspect of the retractable speed barrier system requires repair, the damages aspect can be replaced in situ or the entire system can be replaced.

In one or more embodiments of the present invention, a retractable speed barrier system may use a RADAR detection system, LiDAR detection system, or speed detection camera system that detects the speed of an oncoming vehicle at a predetermined distance from the retractable speed barrier system. If the oncoming vehicle is approaching at a speed that exceeds a predetermined speed, the retractable speed barrier system can deploy winged speed barrier assembly and retract the winged speed barrier assembly when once the vehicle has passed. An electronic display may be used to display the speed of the oncoming vehicle and provide a warning to the oncoming vehicle when the winged speed barrier assembly is deployed.

In one or more embodiments of the present invention, a retractable speed barrier system may use a switch that deploys the winged speed barrier assembly in a first switch state, such as the on position, and retracts the winged speed barrier assembly in a second switch state, such as the off position. An electronic display may optionally be used to display the speed of the oncoming vehicle and/or provide a warning to the oncoming vehicle when the winged speed barrier assembly is deployed.

In one or more embodiments of the present invention, a retractable speed barrier system may use a timer that deploys the winged speed barrier assembly at a first time and retracts the winged speed barrier assembly at a second time. An electronic display may optionally be used to display the speed of the oncoming vehicle and/or provide a warning to the oncoming vehicle when the winged speed barrier assembly is deployed.

In one or more embodiments of the present invention, a retractable speed barrier system may use a safety sensor, such as, for example, a proximity sensor, to detect when a person is in the vicinity of the retractable speed barrier system and prevent the winged speed barrier assembly from deploying when a person or an animal is detected in the immediate vicinity.

In one or more embodiments of the present invention, a retractable speed barrier system may include an emergency vehicle detection system that prevents the retractable speed barrier system from deploying, allowing emergency vehicles to traverse the street or roadway unimpeded at speed.

In one or more embodiments of the present invention, multiple retractable speed barriers may be used in combination across both directions of traffic to prevent a driver from circumventing the retractable speed barrier by swerving into the other lane. In these embodiments, the detection systems may work cooperatively in both directions and make decisions regarding retraction and deployment based on both detection systems.

In one or more embodiments of the present invention, a retractable speed barrier system may be advantageously used in school zones, neighborhoods, parking lots, and any other road or structure in which vehicular speeds need to be forcibly regulated.

In one or more embodiments of the present invention, a retractable speed barrier system may be electronically deactivated by oncoming emergency vehicles such as police, fire, and emergency medical services.

In one or more embodiments of the present invention, a retractable speed barrier system may be used as a physical barrier to prevent drivers from inadvertently entering a street, roadway, or highway in the wrong direction. In certain embodiments, the height of the bump board could be increased substantially, presenting a higher physical obstacle to impede the vehicle of drivers traveling in the wrong direction.

While the present invention has been described with respect to the above-noted embodiments, those skilled in the art, having the benefit of this disclosure, will recognize that other embodiments may be devised that are within the scope of the invention as disclosed herein. Accordingly, the scope of the invention should be limited only by the appended claims.

What is claimed is:

1. A retractable speed barrier system comprising:

a winged speed barrier assembly;

a lateral pivoting assembly comprising a plurality of trapezoidal hinges, wherein each trapezoidal hinge comprises a trapezoid-shaped support plate having a first base of a first length and a second base of a second length longer than the first length, a first hollow cylindrical barrel having the first length and configured to receive a first removable hinge pin, and a second hollow cylindrical barrel having the second length and configured to receive a second removable hinge pin, wherein the first hollow cylindrical barrel is attached to a distal end of the first base of the trapezoid-shaped support plate and the second hollow cylindrical barrel is attached to a distal end of the second base of the trapezoid-shaped support plate;

a hollow frame assembly; and an electrically activated linear actuator, wherein the winged speed barrier assembly is attached to the hollow frame assembly by the lateral pivoting assembly, and wherein the linear actuator causes the winged speed barrier assembly to laterally pivot on the plurality of trapezoidal hinges in a direction perpendicular to the flow of traffic between a retracted positon and a deployed position.

2. The system of claim 1, wherein the winged speed barrier assembly comprises:

a bump board;

a first mounting rod attached to a first longitudinal edge of a bottom side of the bump board;

a second mounting rod attached to a second longitudinal edge of the bottom side of the bump board;

a first strike plate attached to a first longitudinal sidewall of the bump board;

a second strike plate attached to a second longitudinal sidewall of the bump board;

a first distal slide plate attached to a first distal end sidewall of the bump board;

a second distal slide plate attached to a second distal end sidewall of the bump board; and a plurality of force-limiting resting rods disposed perpendicular to, distributed along a longitudinal length of, and attached to, the first and the second mounting rods.

3. The system of claim 1, wherein the lateral pivoting assembly further comprises:

a first angle member;

a second angle member;

a plurality of first removable hinge pins;

a plurality of second removable hinge pins;

a plurality of washers; and a plurality of hinge pin nuts.

4. The system of claim 1, wherein the hollow frame assembly comprises:

a first longitudinal sidewall member;

a second longitudinal sidewall member;

a first distal end sidewall member connecting the first and the second longitudinal sidewall members at the first distal end;

a plurality of second distal end sidewall members and a control box connecting the first and the second longitudinal sidewall members at the second distal end, a plurality of sidewall support braces disposed within, perpendicular to, distributed along a longitudinal length of, and attached to, the first and the second longitudinal sidewall members;

a first longitudinal slide plate attached to a longitudinal edge of the first longitudinal sidewall member;

a second longitudinal slide plate attached to a longitudinal edge of the second longitudinal sidewall member;

a first plurality of springs connecting the first longitudinal slide plate to the first longitudinal sidewall member; and a second plurality of springs connecting the second longitudinal slide plate to the second longitudinal sidewall member.

5. The system of claim 2, wherein the electrically actuated linear actuator comprises:

an actuating rod; and a contact pad, wherein a first side of the contact pad is attached to a distal end of the actuating rod and a second side of the contact pad is attached to a distal end of the bump board.

6. The system of claim 1, further comprising:

an activation system.

7. The system of claim 6, wherein the activation system comprises:

a RADAR detection system configured to detect a speed of an oncoming vehicle at a predetermined distance and retractably deploy the winged speed barrier assembly if the oncoming vehicle speed exceeds a predetermined speed and retract the winged speed barrier assembly once the vehicle has passed;

a speed display configured to display the speed of the oncoming vehicle; and an alert display configured to display a warning when the winged speed barrier assembly is deployed.

8. The system of claim 6, wherein the activation system comprises:

a LiDAR detection system configured to detect a speed of an oncoming vehicle at a predetermined distance and retractably deploy the winged speed barrier assembly if the oncoming vehicle speed exceeds a predetermined speed and retract the winged speed barrier assembly once the vehicle has passed;

a speed display configured to display the speed of the oncoming vehicle; and an alert display configured to display a warning when the winged speed barrier assembly is deployed.

9. The system of claim 6, wherein the activation system comprises:

a speed detection camera system configured to detect a speed of an oncoming vehicle at a predetermined distance and retractably deploy the winged speed barrier assembly if the oncoming vehicle speed exceeds a predetermined speed and retract the winged speed barrier assembly once the vehicle has passed;

a speed display configured to display the speed of the oncoming vehicle; and an alert display configured to display a warning when the winged speed barrier assembly is deployed.

10. The system of claim 6, wherein the activation system comprises:

a switch configured to deploy the winged speed barrier assembly in a first switch state and to retract the winged speed barrier assembly in a second switch state.

11. The system of claim 6, wherein the activation system comprises:

a timer system configured to deploy the winged speed barrier assembly at a first time and retract the winged speed barrier assembly at a second time.

12. The system of claim 1, further comprising:

a safety sensor configured to detect a person in a vicinity of the retractable speed barrier system and prevent the winged speed barrier assembly from deploying if a person is detected in the vicinity.

13. The system of claim 1, further comprising:

asphalt disposed within the hollow frame assembly configured to cover the plurality of sidewall support braces and secure the hollow frame assembly in place.

14. The system of claim 1, wherein the winged speed barrier assembly is deployed in less than one second.

15. The system of claim 1, wherein the winged speed barrier assembly is retracted in less than one second.

16. The system of claim 2, wherein each strike plate comprises:

a support plate;

a contact support member disposed on a first side of the support plate; and a cylindrical support member disposed on a second side of the support plate, wherein the contact support member is attached to a longitudinal sidewall of the bump board.

17. The system of claim 1, wherein the hollow frame assembly is anchored to an asphalt, concrete, or cement surface.

18. The system of claim 2, wherein the winged speed barrier assembly is attached to the lateral pivoting assembly by securing a plurality of first removable hinge pins through a plurality of holes disposed in the first mounting rod, the plurality of trapezoidal hinges, and a plurality of holes disposed in the second mounting rod.

19. The system of claim 1, wherein the lateral pivoting assembly is attached to the hollow frame assembly by securing a plurality of second removable hinge pins through a plurality of holes disposed in a first angle member, the plurality of trapezoidal hinges, and a plurality of holes disposed in a second angle member.

* * * * *